US010522096B2

(12) United States Patent
Chen

(10) Patent No.: US 10,522,096 B2
(45) Date of Patent: Dec. 31, 2019

(54) METHOD FOR ADJUSTING SCREEN LUMINANCE, TERMINAL DEVICE AND STORAGE MEDIUM

(71) Applicant: GUANGDONG OPPO MOBILE TELECOMMUNICATIONS CORP., LTD., Dongguan, Guangdong (CN)

(72) Inventor: Yongxing Chen, Guangdong (CN)

(73) Assignee: GUANGDONG OPPO MOBILE TELECOMMUNICATIONS CORP., LTD., Dongguan, Guangdong (CN)

( * ) Notice: Subject to any disclaimer, the term of this patent is extended or adjusted under 35 U.S.C. 154(b) by 0 days.

(21) Appl. No.: 15/988,283

(22) Filed: May 24, 2018

(65) Prior Publication Data

US 2018/0366072 A1 Dec. 20, 2018

(30) Foreign Application Priority Data

Jun. 19, 2017 (CN) ..... 2017 1 0465588

(51) Int. Cl.
*G09G 3/34* (2006.01)
*G09G 3/20* (2006.01)

(52) U.S. Cl.
CPC ..... *G09G 3/3413* (2013.01); *G09G 3/2003* (2013.01); *G09G 2320/0626* (2013.01); *G09G 2360/16* (2013.01)

(58) Field of Classification Search
CPC ..... G09G 3/3413; G09G 2320/0666; G09G 2320/0626; G09G 2320/08; G09G 2360/16; G09G 3/3406; G09G 5/02; G09G 5/026; G09G 3/2003; G09G 2320/0233
See application file for complete search history.

(56) References Cited

U.S. PATENT DOCUMENTS

2012/0218320 A1* 8/2012 Evanicky ..... G09G 3/006 345/690
2014/0285477 A1* 9/2014 Cho ..... G09G 3/2003 345/207
2015/0348502 A1* 12/2015 Marcu ..... G09G 5/04 345/594

(Continued)

FOREIGN PATENT DOCUMENTS

CN 1330275 A 1/2002
CN 1997128 A 7/2007

(Continued)

OTHER PUBLICATIONS

Skr13, Screen Bright, Jan. 2013, https://forums.videocardz.com/topic/322-screenbright/ (Year: 2013).*

(Continued)

*Primary Examiner* — Koosha Sharifi-Tafreshi
(74) *Attorney, Agent, or Firm* — Lathrop Gage LLP

(57) ABSTRACT

The present disclosure provides a method and an apparatus for adjusting a screen luminance and a terminal device. The method includes: acquiring a proportion of blue light filtered out by adjusting a color temperature of a screen and a first screen luminance after adjusting the color temperature; determining a screen contrast after adjusting the color temperature based on the proportion of blue light and the first screen luminance; and adjusting the screen luminance based on the screen contrast.

17 Claims, 7 Drawing Sheets

(56) References Cited

U.S. PATENT DOCUMENTS

| | | | | |
|---|---|---|---|---|
| 2016/0133202 | A1 | 5/2016 | Saito et al. | |
| 2017/0295351 | A1* | 10/2017 | Yamamoto | G06T 5/009 |
| 2018/0130446 | A1* | 5/2018 | Guest | G09G 5/10 |

FOREIGN PATENT DOCUMENTS

| | | | |
|---|---|---|---|
| CN | 102420997 | A | 4/2012 |
| CN | 104299560 | A | 1/2015 |
| CN | 104392696 | A | 3/2015 |
| CN | 104879681 | A | 9/2015 |
| CN | 104981077 | A | 10/2015 |
| CN | 105070271 | A | 11/2015 |
| CN | 105955585 | A | 6/2016 |
| CN | 105976784 | A | 9/2016 |
| CN | 106155620 | A | 11/2016 |
| CN | 106210311 | A | 12/2016 |
| CN | 106448541 | A | 2/2017 |
| CN | 106782367 | A | 5/2017 |
| CN | 107342066 | A | 11/2017 |

OTHER PUBLICATIONS

Chinese Patent Application No. 201710465588.1 English Translation of Office Action dated Dec. 18, 2018, 7 pages.
Chinese Patent Application No. 201710465588.1 Office Action dated Dec. 18, 2018, 6 pages.
PCT/CN2018/089754 English Translation of the International Search Report and Written Opinion dated Aug. 16, 2018, 11 pp.
European Patent Application No. 18174377.4, Extended Search and Opinion dated Oct. 10, 2018, 10 pages.

* cited by examiner

METHOD FOR ADJUSTING SCREEN LUMINANCE, TERMINAL DEVICE AND STORAGE MEDIUM

CROSS REFERENCE TO RELATED APPLICATION

This application is based upon and claims priority to Chinese Patent Application Serial No. 201710465588.1, filed with the Status Intellectual Property Office of P. R. China on Jun. 19, 2017, the entire contents of which are incorporated herein by reference.

FIELD

The present disclosure relates to a field of screen display technologies, and more particularly to a method for adjusting a screen luminance, a terminal device and a storage medium.

BACKGROUND

At present, a screen of a terminal device presents different colors mainly by superimposing three colors of RGB (Red, Green, Blue). B presents high-energy short-wave blue light. If the blue light is too much, it will cause eye diseases, macular degeneration, and the like. Therefore, many manufacturers adopt a method of filtering out part of the blue light to protect user's eyes.

However, a screen luminance is formed by a ratio of RGB. Since the part of the blue light is filtered out when color temperature is adjusted, reduction in the blue light inevitably leads to reduction in the luminance. If the blue light is filtered out too much, the luminance will be very low. Therefore, the user cannot see the screen clearly, thereby affecting normal use of the user.

SUMMARY

Embodiments of the present disclosure provide a method for adjusting a screen luminance. The method includes: acquiring a proportion of blue light filtered out by adjusting a color temperature of a screen and a first screen luminance after adjusting the color temperature; determining a screen contrast after adjusting the color temperature based on the proportion of blue light and the first screen luminance; and adjusting the screen luminance based on the screen contrast.

Embodiments of the present disclosure provide a terminal device. The terminal device includes a memory; a processor; and computer programs stored in the memory and executable by the processor. The processor is configured to execute the computer programs to implement the above method for adjusting a screen luminance.

Embodiments of the present disclosure provide a non-transitory computer-readable storage medium having stored therein computer programs. When the computer programs are executed by a processor, the above method for adjusting a screen luminance is implemented.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of the embodiments of the present disclosure will become apparent and more readily appreciated from the following descriptions made with reference to the drawings, in which:

FIG. 3(*b*) is a schematic diagram illustrating display content on a screen after adjusting a color temperature according to an embodiment of the present disclosure.

DETAILED DESCRIPTION

Figure 1:
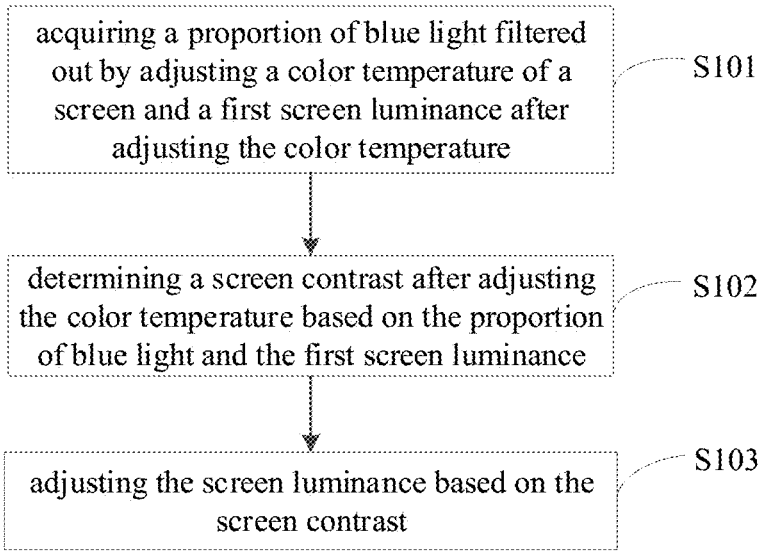
FIG. 1 is a flow chart illustrating a method for adjusting a screen luminance according to an embodiment of the present disclosure.

Embodiments of the present disclosure will be described in detail and examples of the embodiments are illustrated in the drawings. The same or similar elements and the elements having same or similar functions are denoted by like reference numerals throughout the descriptions. The embodiments described herein with reference to the drawings are explanatory, serve to explain the present disclosure, and are not construed to limit the present disclosure.

A method and an apparatus for adjusting a screen luminance and a device according to the embodiments of the present disclosure will be described with reference to the drawings in the following.

The present disclosure relates to a method for adjusting a screen luminance. The method for adjusting a screen luminance includes: acquiring a proportion of blue light filtered out by adjusting a color temperature of a screen and a first screen luminance after adjusting the color temperature; determining a screen contrast after adjusting the color temperature based on the proportion of blue light and the first screen luminance; and adjusting the screen luminance based on the screen contrast.

The present disclosure relates to an apparatus for adjusting a screen luminance. The apparatus for adjusting a screen luminance includes an acquiring module, a determining module and an adjusting module. The acquiring module is configured to acquire a proportion of blue light filtered out by adjusting a color temperature of a screen and a first screen luminance after adjusting the color temperature. The determining module is configured to determine a screen contrast after adjusting the color temperature based on the proportion of blue light and the first screen luminance. The adjusting module is configured to adjust the screen luminance based on the screen contrast.

The present disclosure relates to a terminal device. The terminal device includes a memory; a processor; and computer programs stored in the memory and executable by the processor. The processor is configured to execute the computer programs to implement the above method for adjusting a screen luminance.

The present disclosure relates to a non-transitory computer-readable storage medium having stored therein computer programs. When the computer programs are executed by a processor, the above method for adjusting a screen luminance is implemented.

It can be known from the above analysis on the background that the screen luminance will reduce after the part of blue light B is filtered out. For example, for the screen of the terminal device, the relationship between luminance Y and a ratio of RGB is denoted by a formula of Y=0.299*R+0.587*G+0.114*B. Based on the formula, it can be easily known that, if blue light B is filtered out, luminance Y will reduce. When the luminance reduces to a certain extent, the user cannot see the screen clearly.

To solve the technical problem, the present disclosure provides a method for adjusting a screen luminance, which takes care of the blue light filtering and the screen sharpness, thereby ensuring that after the blue light is filtered out, display content on the screen is clear and the normal use of the user is not affected.

The method for adjusting a screen luminance provided in the present disclosure will be described below in conjunction with embodiments. The implementation body of the method for adjusting a screen luminance provided in the present disclosure is an apparatus for adjusting a screen luminance. The apparatus for adjusting a screen luminance may be a terminal device that has a screen, such as a mobile phone, a computer, a PAD (portable android device), which may be selected according to needs.

FIG. 1 is a flow chart illustrating a method for adjusting a screen luminance according to an embodiment of the present disclosure.

As illustrated in FIG. 1, the method includes acts in the following blocks.

At block S101, a proportion of blue light filtered out by adjusting a color temperature of a screen is acquired and a first screen luminance after adjusting the color temperature is acquired.

In detail, to acquire a situation of the screen luminance after adjusting the color temperature of the screen, the proportion of blue light filtered out by adjusting the color temperature of the screen is acquired and the first screen luminance after adjusting the color temperature is acquired.

It should be noted that, the proportion of blue light filtered out by adjusting the color temperature of the screen may be acquired in different ways based on different scenarios. The following embodiments illustrate the acquiring ways.

In one or more embodiments, since the color temperature of the screen is composed of three colors of RGB, color structure of the screen may change when the blue light filtering operation is performed, and the color temperature of the screen may change accordingly. The change of the color temperature directly reflects the change of the corresponding color. In the embodiment, the correspondence between the color temperature and the ratio of blue light filtered out may be stored in advance. After performing the blue light filtering operation, the above correspondence may be inquired based on the current color temperature to obtain the corresponding ratio of blue light filtered out.

Figure 2:
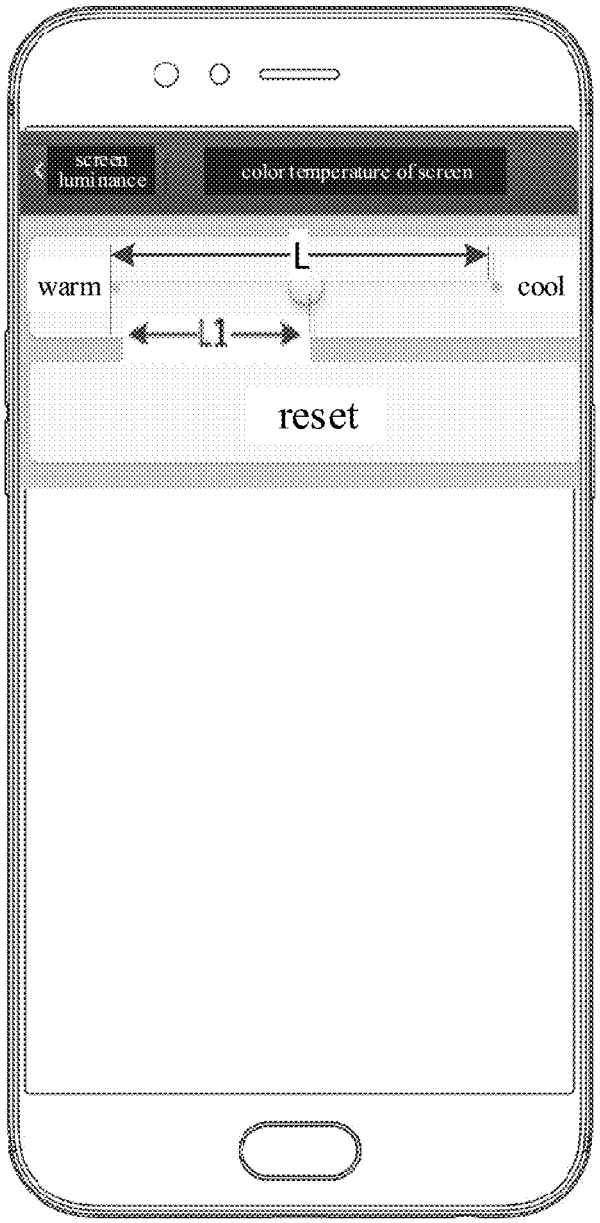
FIG. 2 is a schematic diagram illustrating a scene of adjusting a color temperature of a screen according to an embodiment of the present disclosure.

In one or more embodiments, in practical applications, the terminal device provides a color temperature adjustment slider. The end position of the slider corresponds to the current ratio of blue light filtered out. For example, at the leftmost start position of the slider, the corresponding ratio of blue light filtered out is 100%; at the rightmost end position of the slider, the corresponding ratio of blue light filtered out is 0. Therefore, in the embodiment, as illustrated in FIG. 2, after learning that the color temperature of the screen is adjusted, the current position of the slider is at L1 relative to the leftmost position, the total length of the slider is L, and the ratio of blue right filtered out is (L−L1)/L.

In one or more embodiments, before adjusting the color temperature of the screen, three color components of RGB are the same, for example, are all 1. After adjusting the color temperature of the screen, the color structure of the current color temperature may be analyzed, to know that the current component of the blue light is a, and the ratio of blue light filtered out is 1-a.

In addition, the first screen luminance after adjusting the color temperature may be acquired in different ways based on different scenarios. The following embodiments illustrate the acquiring ways.

In one or more embodiments, the first screen luminance is acquired according to a screen luminance formula. For example, the relationship between screen luminance Y and a ratio of RGB is denoted by a formula of Y=0.299*R+0.587*G+0.114*B. After adjusting the color temperature, a changed proportion of B is brought into the above formula to acquire the first screen luminance.

In one or more embodiments, the current first screen luminance of the screen after adjusting the color temperature of the screen may be acquired by a relevant luminance sensor.

At block S102, a screen contrast after adjusting the color temperature is determined based on the proportion of blue light and the first screen luminance.

In detail, the screen contrast refers to measurement of different luminance levels between the lightest white and the darkest black in light and dark regions. Therefore, the larger the difference range, the greater the contrast. In a certain range, the screen sharpness may be easily optimized by providing the contrast.

Figure 3A:
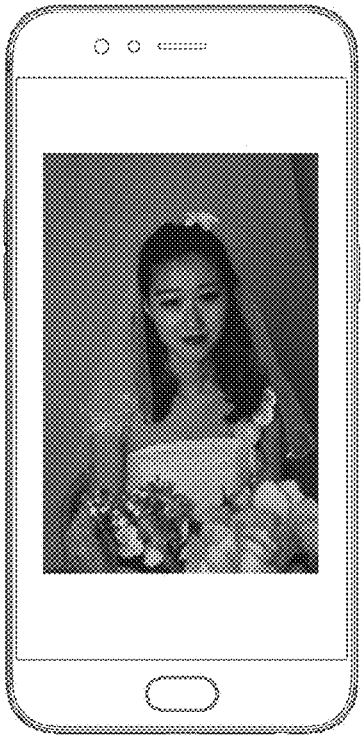
FIG. 3(*a*) is a schematic diagram illustrating display content on a screen after adjusting a color temperature according to the related art.
Figure 3B:
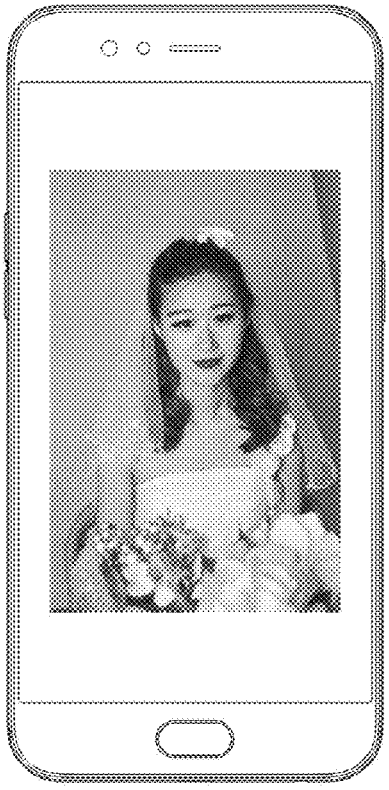

For example, as illustrated in FIG. 3(*a*), current display content on the screen may not be very clear because the screen luminance is not high. After the screen contrast is increased, as illustrated in FIG. 3(*b*), the display content on the screen may be differentiated clearly and the contrast is bigger, thereby providing the user with clearer display effect.

Therefore, in the embodiment, to compensate for the screen luminance loss after the blue light is filtered out, the screen contrast after adjusting the color temperature is determined, and the screen sharpness is improved by setting a relatively high contrast.

However, during the actual operation, if the contrast increases to a higher level, it may cause a waste of power, increase processing pressure of the system, etc., and if the contrast reduces to a lower level, it may still make the screen not clear enough. Therefore, in the embodiment of the present disclosure, the screen contrast conforming to the current actual situation of the screen after adjusting the color temperature is determined based on the proportion of blue light filtered out and the first screen luminance.

Certainly, in practical applications, different methods may be adopted to determine the screen contrast after adjusting the color temperature based on the proportion of blue light filtered out and the first screen luminance according to different scenarios. Embodiments are as follows.

In one or more embodiments, a preset algorithm is set in advance according to the correspondence between the ratio of blue light filtered out with the first screen luminance and the screen contrast.

Therefore, the ratio of blue light filtered out and the first screen luminance are calculated based on the preset algorithm to acquire the screen contrast after adjusting the color temperature.

In one or more embodiment, since different ratios of blue light filtered out with first screen luminances correspond to different screen contrasts, a contrast database including correspondence between the ratios of blue light filtered out with the first screen luminances and the screen contrasts is set in advance. According to the ratio of blue light filtered out, the color temperature of the screen after adjusting the color temperature is acquired, and the preset contrast database is inquired to acquire the screen contrast corresponding to the color temperature of the screen and the first screen luminance.

At block S103, the screen luminance is adjusted based on the screen contrast.

In detail, the screen luminance is adjusted according to the determined screen contrast, so that the current screen is displayed clearly and the visual experience is improved.

Therefore, the method for adjusting a screen luminance provided in the present disclosure ensures that after the part of blue light is filtered out, the screen visibility is still good, and change of the screen sharpness, which is resulted from the luminance loss after filtering out the blue light, may be reduced. The color temperature is adjusted without losing the screen visibility and sharpness.

With the method for adjusting a screen luminance in embodiments of the present disclosure, the proportion of blue light filtered out by adjusting the color temperature of the screen is acquired and the first screen luminance after adjusting the color temperature is acquired; the screen contrast after adjusting the color temperature is determined based on the proportion of blue light and the first screen luminance; and the screen luminance is adjusted based on the screen contrast. Therefore, by increasing the screen contrast, screen visibility may be enhanced, thereby avoiding screen sharpness reduction caused by luminance loss after filtering out the blue light and improving user experience.

Based on the above embodiments, it should be understood that, in actual operation, if the screen luminance is low before adjusting the color temperature of the screen, the screen luminance will be extremely low after the blue light is filtered out, and the screen will not be clearly visible, and the increase in contrast will also be useless. Therefore, before adjusting the color temperature of the screen, it may confirm the screen luminance first.

Figure 4:
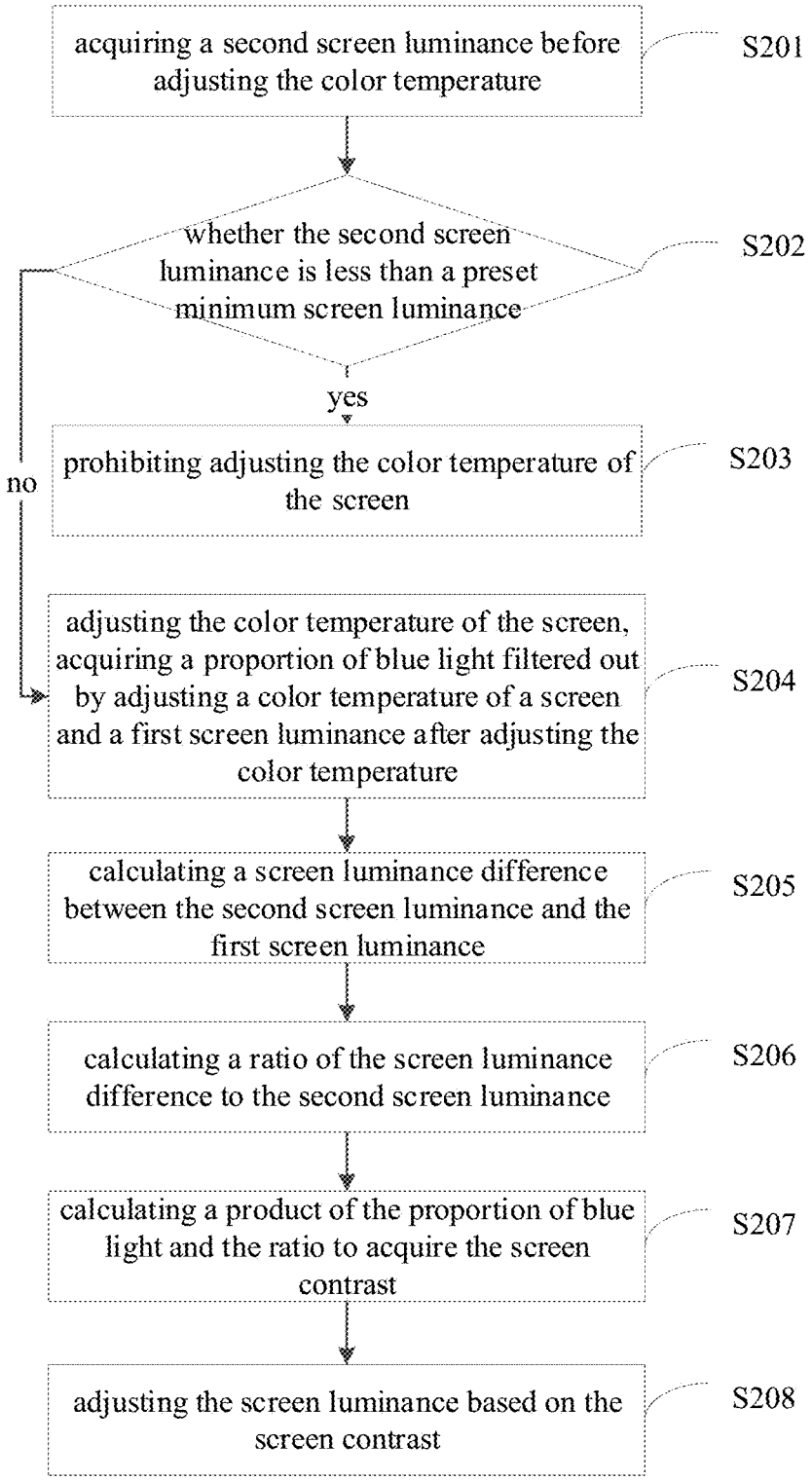
FIG. 4 is a flow chart illustrating a method for adjusting a screen luminance according to another embodiment of the present disclosure.

FIG. 4 is a flow chart illustrating a method for adjusting a screen luminance according to another embodiment of the present disclosure. As illustrated in FIG. 4, the method includes acts in the following blocks.

At block S201, a second screen luminance before adjusting the color temperature is acquired.

In detail, the second screen luminance is an initial screen luminance before adjusting the color temperature. The initial screen luminance is calculated by the terminal device on current ambient luminance based on the preset algorithm.

At block S202, it is judged whether the second screen luminance is less than a preset minimum screen luminance.

It can be understood that the minimum screen luminance is set in advance based on a large amount of experimental data. The minimum screen luminance is to guarantee that the screen sharpness may be enhanced by increasing the screen contrast although the screen luminance reduces after the blue light is filtered out.

In detail, it is judged whether the second screen luminance is less than the preset minimum screen luminance to determine whether a status of the current screen luminance is suitable for filtering out the blue light.

At block S203, when the second screen luminance is less than the preset minimum screen luminance, adjusting the color temperature of the screen is prohibited.

In detail, if the second screen luminance is less than the minimum screen luminance, it indicates that based on the state of the current screen luminance, if the blue light is filtered out, the screen luminance will be too low, and even if the screen contrast is adjusted, the screen sharpness cannot be significantly improved. At this time, to make the user to see the screen, adjusting the color temperature of the screen is prohibited.

At block S204, when the second screen luminance is not less than the preset minimum screen luminance, the color temperature of the screen is adjusted, a proportion of blue light filtered out by adjusting the color temperature of the screen is acquired and a first screen luminance after adjusting the color temperature is acquired.

In detail, if the second screen luminance is not less than the minimum screen luminance, it indicates that the state of the current screen luminance can improve the screen sharpness by increasing the screen contrast after adjusting the color temperature, which may take care of the color temperature adjustment and screen sharpness.

At block S205, a screen luminance difference between the second screen luminance and the first screen luminance is calculated.

At block S206, a ratio of the screen luminance difference to the second screen luminance is calculated.

At block S207, a product of the proportion of blue light and the ratio to acquire the screen contrast is calculated.

At block S208, the screen luminance is adjusted based on the screen contrast.

In detail, the embodiment provides a specific calculation method of the foregoing preset algorithm. In the embodiment, the difference between the second screen luminance and the first screen luminance is calculated to obtain the screen luminance difference after adjusting the color temperature.

Furthermore, the ratio of the screen luminance difference to the second screen luminance is calculated. Further, the ratio of the blue light is multiplied by the ratio, and the product is regarded as the screen contrast. Thus, the display of the screen is controlled according to the screen contrast.

To make those skilled in the art understand the present disclosure more clearly, the implementation process of the method for adjusting a screen luminance provided in the embodiments of the present disclosure is now combined with an embodiment under a scenario.

Figure 5:
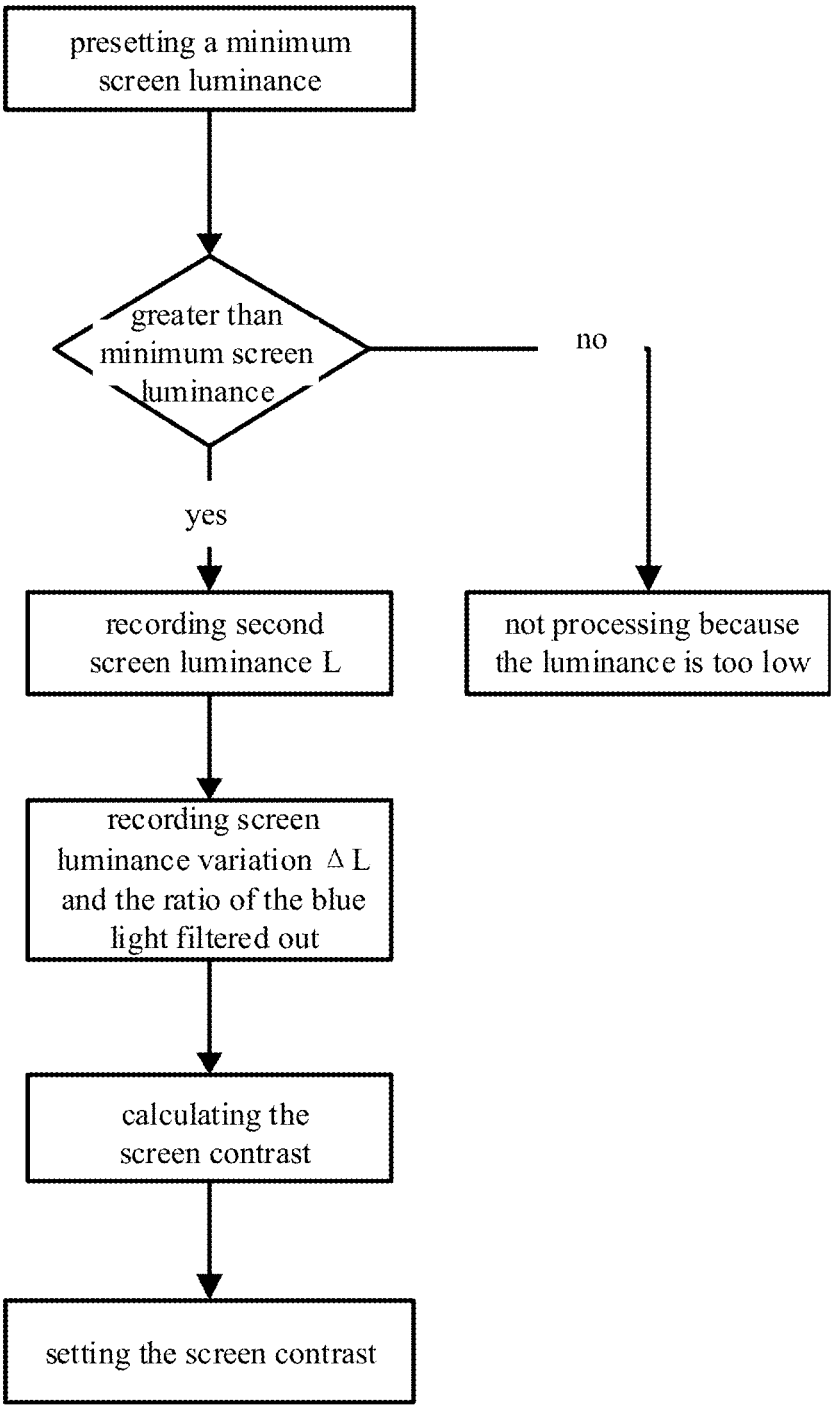
FIG. 5 is a flow chart illustrating a method for adjusting a screen luminance according to another embodiment of the present disclosure.

As illustrated in FIG. 5, the minimum screen luminance of adjusting the color temperature is preset. It is determined whether the current screen luminance is less than the preset minimum screen luminance. If the current screen luminance is less than the preset minimum screen luminance, the color temperature adjustment is not performed because the screen luminance is lower. If the current screen luminance is not less than the preset minimum screen luminance, the second screen luminance L is recorded. After the part of the blue light is filtered out, the screen luminance changes, and the screen luminance variation $\Delta L$ and the ratio of the blue light filtered out at this time are recorded. The ratio of the screen luminance variation is ΔL/L, and the screen contrast is denoted by a formula of ΔL/L* ratio. The display of the screen is adjusted according to this screen contrast.

In conclusion, with the method for adjusting a screen luminance provided in the embodiments of the present disclosure, the color temperature adjustment is performed when the screen luminance is greater than a certain degree, to avoid that, when the screen luminance is lower, after the blue light is filtered out, even if the screen contrast is improved, the screen cannot be clearly visible, further to enhance the user experience.

To achieve the above objectives, the present disclosure further provides an apparatus for adjusting a screen luminance.

Figure 6:
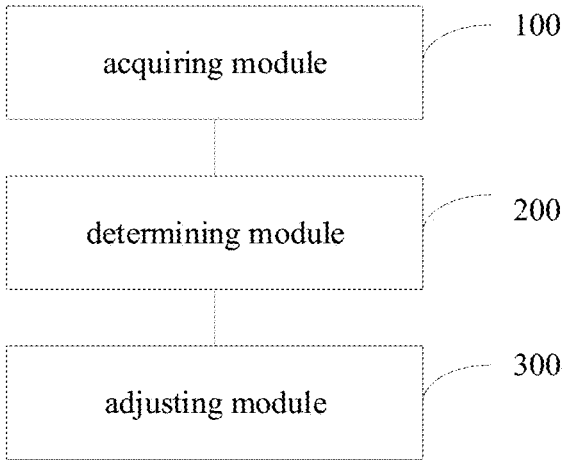
FIG. 6 is a block diagram illustrating an apparatus for adjusting a screen luminance according to an embodiment of the present disclosure.

FIG. 6 is a block diagram illustrating an apparatus for adjusting a screen luminance according to an embodiment of the present disclosure.

As illustrated in FIG. 6, the apparatus may include an acquiring module 100, a determining module 200 and an adjusting module 300.

The acquiring module 100 is configured to acquire a proportion of blue light filtered out by adjusting a color temperature of a screen and a first screen luminance after adjusting the color temperature.

The determining module 200 is configured to determine a screen contrast after adjusting the color temperature based on the proportion of blue light and the first screen luminance.

In an embodiment of the present disclosure, the determining module 200 is configured to perform calculation based on the proportion of blue light and the first screen luminance and based on a preset algorithm to acquire the screen contrast after adjusting the color temperature.

The adjusting module 300 is configured to adjust the screen luminance based on the screen contrast.

It should be noted that the foregoing description on the method for adjusting a screen luminance may be also applicable to the apparatus for adjusting a screen luminance according to embodiments of the present disclosure. The implementation principle of the two is similar, and details are not described herein again.

In conclusion, with the apparatus for adjusting a screen luminance in embodiments of the present disclosure, the proportion of blue light filtered out by adjusting the color temperature of the screen is acquired and the first screen luminance after adjusting the color temperature is acquired; the screen contrast after adjusting the color temperature is determined based on the proportion of blue light and the first screen luminance; and the screen luminance is adjusted based on the screen contrast. Therefore, by increasing the screen contrast, screen visibility may be enhanced, thereby avoiding screen sharpness reduction caused by luminance loss after filtering out the blue light and improving user experience.

Figure 7:
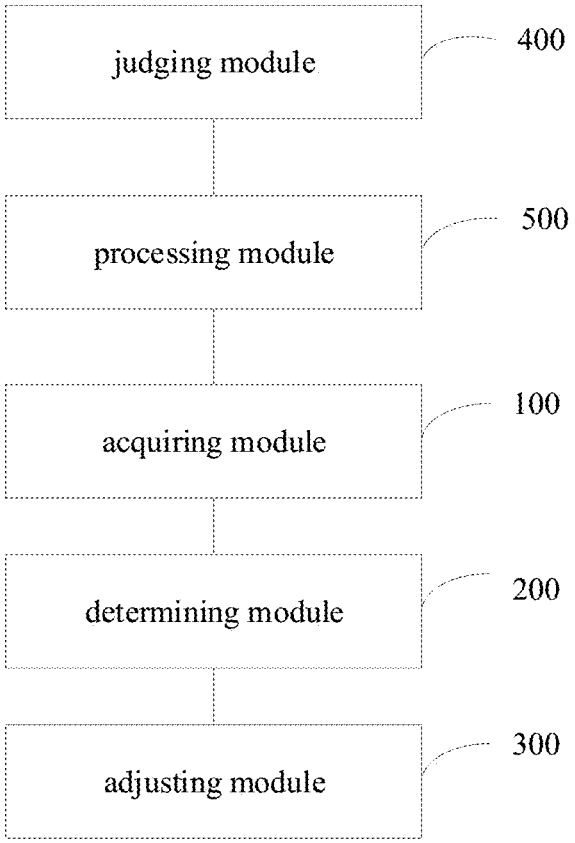
FIG. 7 is a block diagram illustrating an apparatus for adjusting a screen luminance according to another embodiment of the present disclosure.

FIG. 7 is a block diagram illustrating an apparatus for adjusting a screen luminance according to another embodiment of the present disclosure. As illustrated in FIG. 7, on the basis of FIG. 6, the apparatus further includes a judging module 400 and a processing module 500.

In the embodiment, the acquiring module 100 is further configured to, before acquiring the proportion of blue light filtered out by adjusting the color temperature of the screen, acquire a second screen luminance before adjusting the color temperature.

The judging module 400 is configured to judge whether the second screen luminance is less than a preset minimum screen luminance.

The processing module 500 is configured to, when the second screen luminance is less than the preset minimum screen luminance, prohibit adjusting the color temperature of the screen.

It should be noted that the foregoing description on the method for adjusting a screen luminance may be also applicable to the apparatus for adjusting a screen luminance according to embodiments of the present disclosure. The implementation principle of the two is similar, and details are not described herein again.

In conclusion, with the apparatus for adjusting a screen luminance in embodiments of the present disclosure, the color temperature adjustment is performed when the screen luminance is greater than a certain degree, to avoid that, when the screen luminance is lower, after the blue light is filtered out, even if the screen contrast is improved, the screen cannot be clearly visible, further to enhance the user experience.

Figure 8:
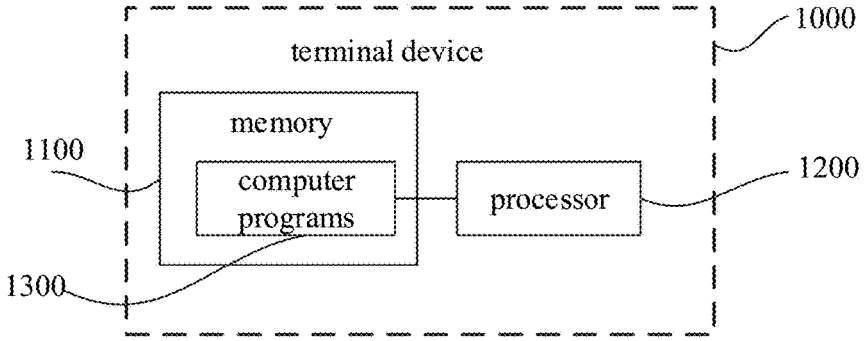
FIG. 8 is a block diagram illustrating a terminal device according to an embodiment of the present disclosure.

To achieve the above embodiments, the present disclosure further provides a terminal device. FIG. 8 is a block diagram illustrating a terminal device according to an embodiment of the present disclosure. As illustrated in FIG. 8, the terminal device 1000 may include a memory 1100, a processor 1200 and computer programs 1300 stored in the memory 1100 and executable by the processor 1200. The processor 1200 is configured to execute the computer programs 1300 to implement the method for adjusting a screen luminance according to any one of the above embodiments of the present disclosure.

In conclusion, with the terminal device in embodiments of the present disclosure, the proportion of blue light filtered out by adjusting the color temperature of the screen is acquired and the first screen luminance after adjusting the color temperature is acquired; the screen contrast after adjusting the color temperature is determined based on the proportion of blue light and the first screen luminance; and the screen luminance is adjusted based on the screen contrast. Therefore, by increasing the screen contrast, screen visibility may be enhanced, thereby avoiding screen sharpness reduction caused by luminance loss after filtering out the blue light and improving user experience.

To achieve the above embodiments, the present disclosure further provides non-transitory computer-readable storage medium having stored therein computer programs. When the computer programs are executed by a processor, the method for adjusting a screen luminance according to any one of the above embodiments of the present disclosure is implemented.

Figure 9:
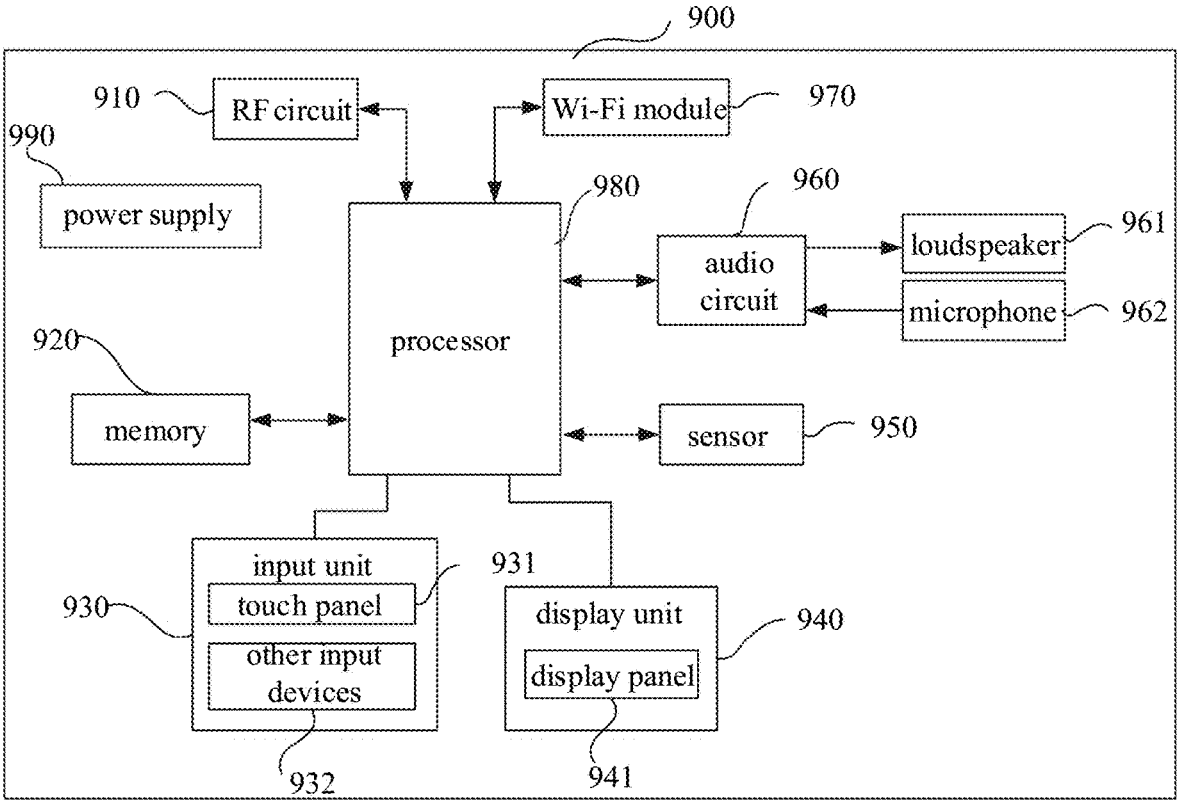
FIG. 9 is a schematic diagram of an internal structure of a terminal device according to an embodiment of the present disclosure.

FIG. 9 is a schematic diagram of an internal structure of a terminal device according to an embodiment of the present disclosure. With reference to FIG. 9, the terminal device 900 includes a radio frequency (RF) circuit 910, a memory 920, an input unit 930, a display unit 940, a sensor 950, an audio circuit 960, a wireless fidelity (Wi-Fi) module 970, a processor 980 and a power supply 990, and the like. It may be understood by those skilled in the art that the structures of the terminal device 900 illustrated in FIG. 9 do not limit the structures of the terminal device. The terminal device may include less or more components than those illustrated in FIG. 9 or combinations thereof or have a different arrangement of components.

The RF circuit 910 may be configured to receive or transmit a signal during a process of transmitting or receiving a message or making a call. The RF circuit 910 may be configured to receive downlink data from a base station and to transmit the downlink data to the processor 980. Alternatively, the RF circuit 910 may be configured to transmit uplink data to the base station. In general, the RF circuit includes but is not limited to an antenna, at least one amplifier, a transceiver, a coupler, a low noise amplifier (LNA), a diplexer and the like. Furthermore, the RF circuit 910 may be further configured to communicate with other devices via wireless communication and network. The above wireless communication may adopt any communication standard or protocol, which includes but is not limited to global system of mobile communication (GSM), general packet radio service (GPRS), code division multiple access (CDMA), wideband code division multiple access (WCDMA), long term evolution (LTE), e-mail, short messaging service (SMS) and the like.

The memory 920 may be configured to store software programs or modules. The processor 980 is configured to execute various functional applications and data processes of the terminal device 900 by running the software programs and modules stored in the memory 920. The memory 920 may mainly include a program storage region and a data storage region. The program storage region may store an operation system, at least one function required applications (such as an application having a sound playing function, an application having an image playing function) and the like. The data storage region may store data produced by using the terminal device 900 (such as audio data, an address book) and the like. In addition, the memory 920 may include a high speed random access memory and may include a non-volatility memory, such as at least one disk memory, a flash memory, or other volatility solid state memory.

The input unit 930 may be configured to receive figure or character information inputted and generate a key signal input related to a user setup or function control of the terminal device 900. In detail, the input unit 930 may include a touch panel 931 and other input devices 932. The touch panel 931 (also called as touch screen) may be configured to gather touch operations near or on the touch panel 931 (such as an operation on the touch panel 931 or near the touch panel 931 of the user with a finger, a stylus or other suitable objects or attachments), and drive corresponding connected device according to a preset program. In an embodiment, the touch panel 931 may include a touch detection device and a touch controller. The touch detection device detects an orientation of the user's touch, detects a signal caused by the touch operation and sends the signal to the touch controller. The touch controller receives the touch information on the touch detection device, converts the touch information to touch point coordinates, and sends the touch point coordinates to the processor 980. Furthermore, the touch controller may receive and execute a command sent from the processor 980. The touch panel 931 may be implemented as resistance typed, capacitive typed, infrared typed and surface acoustic wave typed. In addition to the touch panel 931, the input unit 930 may further include other input devices 932. In detail, the other input devices 932 may include but without limitation to one or more of a physical keyboard, a functional key (such as a volume control key, a switch key and the like).

The display unit 940 may be configured to display information inputted by the user or information provided to the user or various menus of the terminal device 900. The display unit 940 may include a display panel 941. In an embodiment, the display panel 941 may be configured as a liquid crystal display (LCD), an organic light-emitting diode (OLED) and the like. In an embodiment, the touch panel 931 may cover the display panel 941. When the touch panel 931 detects the touch operation on the touch panel 931 or near the touch panel 931, the touch operation is transmitted to the processor 980 to determine a type of the touch event. Thereafter, the processor 980 provides a corresponding visual output on the display panel 941 according to the type of the touch event. Although the touch panel 931 and the display panel 941 are two separate components to realize an input and output function of the terminal device 900 illustrated in FIG. 9, in certain embodiments, the touch panel 931 and the display panel 941 may be integrated to realize the input and output function of the terminal device 900, The terminal device 900 may further include at least one sensor 950, such as a gyroscope, an optical sensor, a motion sensor and other sensors. In detail, the gyroscope is configured to collect a rotation angular velocity of the terminal device 900. The optical sensor may include a surrounding light sensor and a proximity sensor. The surrounding light sensor may adjust a brightness of the display panel 941 according to surrounding lights. The proximity sensor may close the display panel 941 and/or backlight when the terminal device 900 moves near ears of the user. The motion sensor may include an acceleration sensor, for measuring the acceleration value in various directions via the acceleration sensor, measuring a value and a direction of gravity when the terminal device 900 is static, and identifying a state of the terminal device 900 (such as landscape screen and portrait screen switching), jitter related functions (such as a pedometer, a knocking) and the like. Furthermore, the terminal device 900 may be configured with a barometer, a hygrometer, a thermometer, an infrared sensor and other sensors.

The audio circuit 960, a loudspeaker 961 and a microphone 962 may provide an audio interface between the user and the terminal device 900. The audio circuit 960 may transmit an electrical signal converted from the audio data received to the loudspeaker 961. The loudspeaker 961 converts the electrical signal to a sound signal and output the sound signal. In another aspect, the microphone 962 may convert gathered sound singles to electrical signals. The audio circuit 960 receives and converts the electrical signals to audio data and outputs the audio data to the processor 980 to be processed. The audio data processed by the processor 980 may be transmitted to another terminal device via the RF circuit 910 or may be stored in the memory 920 to be subsequently processed.

Wi-Fi is a short distance wireless communication technology. The terminal device 900 may help the user to receive or send an e-mail, search webpages, access to stream medium via the Wi-Fi module 970. The Wi-Fi module 970 provides a wireless broadband Internet access. Although the Wi-Fi module 970 is illustrated in FIG. 9, it may be understood that, the Wi-Fi module 970 is not necessary for the terminal device 900, thus it may be omitted according to demands.

The processor 980 is a control center of the terminal device 900, which utilizes various interfaces and wires to connect various parts of the terminal device 900. By running or executing the software program and/or modules stored in the memory 920, and by invoking data stored in the memory 920, the various functions and data processing functions may be executed, thus integrally monitoring the terminal device 900. In an embodiment, the processor 980 may include one or more processing units. In an embodiment, the processor 980 may be integrated with an application processor or a modem processor. The application processor mainly processes the operation system, a user interface and an application. The modem processor mainly processes wireless communication. It may be understood that, the above modem controller may be not integrated in the processor 980.

The terminal device 900 may further includes a power supply 990 (such as a battery) for providing powers to various parts of the terminal device. Alternatively, the power supply may be logically connected to a power management system and the processor 980, thereby managing a charging, discharging and power consumption via the power management system.

In an embodiment, the terminal device 900 may further include a camera, a Bluetooth module and the like.

In embodiments of the present disclosure, the processor 980 included in the terminal device may execute the computer programs stored in the memory to achieve the above method, which will be not repeated here.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the above phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art may combine the different embodiments or examples described in this specification and features of different embodiments or examples without conflicting with each other.

Terms such as "first" and "second" are used herein for purposes of description and are not intended to indicate or imply relative importance or significance or imply the number of technical features. Furthermore, the feature defined by "first" or "second" may indicate or imply including at least one feature. In the description of the present disclosure, "a plurality of" refers to two or more unless otherwise specified.

Any process or method described in a flow chart or described herein in other ways may be understood to include one or more modules, segments or portions of codes of executable instructions for achieving specific logical functions or steps in the process, and the scope of a preferred embodiment of the present disclosure includes other implementations, in which the functions may be executed in other orders instead of the order illustrated or discussed, including in a basically simultaneous manner or in a reverse order, which should be understood by those skilled in the art.

Any process or method described in a flow chart or described herein in other ways may be understood to be a sequence table of executable instructions for achieving logical functions, which may be realized in any computer-readable medium for being used by the instruction execution system, device or apparatus (for example, the system based on the computer, the system including the processor or other systems capable of reading instructions from the instruction execution system, device or apparatus and executing the instructions) or being used in combination with the instruction execution system, device or apparatus. In the specification, "computer-readable medium" may be any device including, storing, communicating, broadcasting or transmitting programs for being used by the instruction execution system, device or apparatus or being used in combination with the instruction execution system, device or apparatus. Specific examples of the computer-readable medium (non-exhaustiveness list) include: electrical connection (terminal device) having one or one wires, portable computer disk box (magnetic device), random access memory (RAM), read only memory (ROM), electrically programmable read-only-memory (EPROM or flash memory), fiber device, and portable CD-ROM. In addition, the computer-readable medium may even to paper on which programs can be printed or other appropriate medium, this is because optical scanning may be performed on the paper or the other medium, and then edit, interpretation or any other appropriate way if necessary are performed to electrically obtain the programs, and then the programs are stored in the computer storage.

It should be understood that each part of the present disclosure may be realized by the hardware, software, firmware or their combination. In the above embodiments, a plurality of steps or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

Those skilled in the art shall understand that all or parts of the steps in the above exemplifying method of the present disclosure may be achieved by commanding the related hardware with programs. The programs may be stored in a computer readable storage medium, and the programs include one or a combination of the steps in the method embodiments of the present disclosure when run on a computer.

In addition, each function cell of the embodiments of the present disclosure may be integrated in a processing module, or these cells may be separate physical existence, or two or more cells are integrated in a processing module. The integrated module may be realized in a form of hardware or in a form of software function modules. When the integrated module is realized in a form of software function module and is sold or used as a standalone product, the integrated module may be stored in a computer readable storage medium.

The storage medium mentioned above may be read-only memories, magnetic disks or CD, etc. Although explanatory embodiments have been shown and described, it would be appreciated by those skilled in the art that the above embodiments cannot be construed to limit the present disclosure, and changes, alternatives, and modifications can be made in the embodiments without departing from scope of the present disclosure.

What is claimed is:

1. A method for adjusting a screen luminance, comprising the acts of:

(a) acquiring a proportion of blue light filtered out by adjusting a color temperature of a screen based on a relationship between the color temperature and the proportion of blue light filtered out;

(b) acquiring a first screen luminance after adjusting the color temperature;

(c) determining a screen contrast after adjusting the color temperature based on the proportion of blue light and the first screen luminance;

(d) adjusting the screen luminance based on the screen contrast; and before the act (a):

acquiring a second screen luminance before adjusting the color temperature;

judging whether the second screen luminance is less than a preset minimum screen luminance;

in response to determining that the second screen luminance is less than the preset minimum screen luminance, prohibiting the act (d); and, in response to determining that the second screen luminance is not less than the preset minimum screen luminance, performing the acts (a)-(d).

2. The method according to claim 1, wherein determining the screen contrast after adjusting the color temperature based on the proportion of blue light and the first screen luminance comprises:

performing calculation of a preset algorithm based on the proportion of blue light and the first screen luminance to acquire the screen contrast after adjusting the color temperature.

3. The method according to claim 2, wherein performing the calculation based on the proportion of blue light and the first screen luminance and based on the preset algorithm to acquire the screen contrast after adjusting the color temperature comprises:

calculating a screen luminance difference between the second screen luminance and the first screen luminance;

calculating a ratio of the screen luminance difference to the second screen luminance; and calculating a product of the proportion of blue light and the ratio to acquire the screen contrast.

4. The method according to claim 1, wherein determining the screen contrast after adjusting the color temperature based on the proportion of blue light and the first screen luminance comprises:

acquiring a color temperature of the screen after adjusting the color temperature based on the proportion of blue light; and querying a pre-stored contrast database to acquire a screen contrast corresponding to the color temperature of the screen and the first screen luminance.

5. The method according to claim 1, wherein acquiring the proportion of blue light filtered out by adjusting the color temperature of the screen comprises:

acquiring the color temperature of the screen after filtering out the blue light; and querying a pre-stored correspondence between color temperatures and ratios of blue light based on the acquired color temperature to acquire the proportion of blue light filtered out by adjusting the color temperature of the screen.

6. The method according to claim 1, wherein acquiring the proportion of blue light filtered out by adjusting the color temperature of the screen comprises:

providing a color temperature adjustment slider;

obtaining a current position of the slider after adjusting the color temperature of the screen; and acquiring the proportion of blue light filtered out by adjusting the color temperature of the screen based on the current position of the slider and a length of the slider.

7. The method according to claim 1, wherein acquiring the proportion of blue light filtered out by adjusting the color temperature of the screen comprises:

obtaining a component of the blue light after adjusting the color temperature of the screen; and acquiring the proportion of blue light filtered out by adjusting the color temperature of the screen based on the component of the blue light.

8. A terminal device, comprising:

a memory;

a processor; and computer programs stored in the memory and executable by the processor, wherein the processor is configured to execute the computer programs to implement acts of:

acquiring a second screen luminance before adjusting the color temperature;

judging whether the second screen luminance is less than a preset minimum screen luminance;

in response to determining that the second screen luminance is less than the preset minimum screen luminance, prohibiting adjusting the color temperature of the screen;

in response to determining that the second screen luminance is not less than the preset minimum screen luminance, (a) acquiring a proportion of blue light filtered out by adjusting a color temperature of a screen based on a relationship between the color temperature and the proportion of blue light filtered out;

(b) acquiring a first screen luminance after adjusting the color temperature;

(c) determining a screen contrast after adjusting the color temperature based on the proportion of blue light and the first screen luminance;

(d) adjusting the screen luminance based on the screen contrast; and, before the act (a):

acquiring a second screen luminance before adjusting the color temperature;

judging whether the second screen luminance is less than a preset minimum screen luminance;

in response to determining that the second screen luminance is less than the preset minimum screen luminance, prohibiting the step (d); and, in response to determining that the second screen luminance is not less than the preset minimum screen luminance, performing the steps (a)-(d).

9. The terminal device according to claim 8, wherein the processor is configured to determine the screen contrast after adjusting the color temperature based on the proportion of blue light and the first screen luminance by acts of:

performing calculation of a preset algorithm based on the proportion of blue light and the first screen luminance to acquire the screen contrast after adjusting the color temperature.

10. The terminal device according to claim 9, wherein the processor is configured to perform the calculation based on the proportion of blue light and the first screen luminance and based on the preset algorithm to acquire the screen contrast after adjusting the color temperature by acts of:

calculating a screen luminance difference between the second screen luminance and the first screen luminance;

calculating a ratio of the screen luminance difference to the second screen luminance; and calculating a product of the proportion of blue light and the ratio to acquire the screen contrast.

11. The terminal device according to claim 8, wherein the processor is configured to determine the screen contrast after adjusting the color temperature based on the proportion of blue light and the first screen luminance by acts of:

acquiring a color temperature of the screen after adjusting the color temperature based on the proportion of blue light; and querying a pre-stored contrast database to acquire a screen contrast corresponding to the color temperature of the screen and the first screen luminance.

12. The terminal device according to claim 8, wherein the processor is configured to acquire the proportion of blue light filtered out by adjusting the color temperature of the screen by acts of:

acquiring the color temperature of the screen after filtering out the blue light, and querying a pre-stored correspondence between color temperatures and ratios of blue light based on the acquired color temperature to acquire the proportion of blue light filtered out by adjusting the color temperature of the screen;

or providing a color temperature adjustment slider, obtaining a current position of the slider after adjusting the color temperature of the screen, and acquiring the proportion of blue light filtered out by adjusting the color temperature of the screen based on the current position of the slider and a length of the slider;

or obtaining a component of the blue light after adjusting the color temperature of the screen, and acquiring the proportion of blue light filtered out by adjusting the color temperature of the screen based on the component of the blue light.

13. A non-transitory computer-readable storage medium having stored therein computer programs, wherein when the computer programs are executed by a processor, a method for adjusting a screen luminance is implemented, the method comprises the acts of:

(a) acquiring a proportion of blue light filtered out by adjusting a color temperature of a screen based on a relationship between the color temperature and the proportion of blue light filtered out;

(b) acquiring a first screen luminance after adjusting the color temperature;

(c) determining a screen contrast after adjusting the color temperature based on the proportion of blue light and the first screen luminance;

(d) adjusting the screen luminance based on the screen contrast; and, before the act (a):

acquiring a second screen luminance before adjusting the color temperature;

judging whether the second screen luminance is less than a preset minimum screen luminance;

in response to determining that the second screen luminance is less than the preset minimum screen luminance, prohibiting the act (d); and, in response to determining that the second screen luminance is not less than the preset minimum screen luminance, performing the acts (a)-(d).

14. The non-transitory computer-readable storage medium according to claim 13, wherein determining the screen contrast after adjusting the color temperature based on the proportion of blue light and the first screen luminance comprises:

performing calculation of a preset algorithm based on the proportion of blue light and the first screen luminance to acquire the screen contrast after adjusting the color temperature.

15. The non-transitory computer-readable storage medium according to claim 14, wherein performing the calculation based on the proportion of blue light and the first screen luminance and based on the preset algorithm to acquire the screen contrast after adjusting the color temperature comprises:

calculating a screen luminance difference between the second screen luminance and the first screen luminance;

calculating a ratio of the screen luminance difference to the second screen luminance; and calculating a product of the proportion of blue light and the ratio to acquire the screen contrast.

16. The non-transitory computer-readable storage medium according to claim 13, wherein determining the screen contrast after adjusting the color temperature based on the proportion of blue light and the first screen luminance comprises:

acquiring a color temperature of the screen after adjusting the color temperature based on the proportion of blue light; and querying a pre-stored contrast database to acquire a screen contrast corresponding to the color temperature of the screen and the first screen luminance.

17. The non-transitory computer-readable storage medium according to claim 13, wherein acquiring the proportion of blue light filtered out by adjusting the color temperature of the screen comprises:

acquiring the color temperature of the screen after filtering out the blue light, and querying a pre-stored correspondence between color temperatures and ratios of blue light based on the acquired color temperature to acquire the proportion of blue light filtered out by adjusting the color temperature of the screen;

or providing a color temperature adjustment slider, obtaining a current position of the slider after adjusting the color temperature of the screen, and acquiring the proportion of blue light filtered out by adjusting the color temperature of the screen based on the current position of the slider and a length of the slider;

or obtaining a component of the blue light after adjusting the color temperature of the screen, and acquiring the proportion of blue light filtered out by adjusting the color temperature of the screen based on the component of the blue light.

* * * * *